United States Patent [19]

Shulyak

[11] Patent Number: 4,496,276

[45] Date of Patent: Jan. 29, 1985

[54] SHEAR

[75] Inventor: Lev Shulyak, Worcester, Mass.

[73] Assignee: Shel Industries, Inc., Boston, Mass.

[21] Appl. No.: 414,569

[22] Filed: Sep. 2, 1982

[51] Int. Cl.[3] ..... B26F 3/02

[52] U.S. Cl. ..... 225/65; 225/58

[58] Field of Search ..... 225/58, 65; 30/124

[56] References Cited

U.S. PATENT DOCUMENTS

| | | | |
|---|---|---|---|
| 2,401,286 | 5/1946 | Wright . | |
| 2,447,518 | 8/1948 | Marinsky . | |
| 2,472,761 | 6/1949 | Reed . | |
| 2,528,958 | 11/1950 | Johnson . | |
| 2,609,877 | 9/1952 | Hanington . | |
| 2,677,425 | 5/1954 | Broyles . | |
| 2,734,575 | 2/1956 | Gilbreth et al. . | |
| 3,556,367 | 1/1971 | Ikeda . | |
| 3,684,141 | 8/1972 | Hall | 225/65 |
| 3,904,095 | 9/1975 | Doyle | 225/56 |
| 4,405,068 | 9/1983 | Blair | 225/65 |

*Primary Examiner*—Donald R. Schran
*Assistant Examiner*—James Wolfe

[57] ABSTRACT

A shear for tape in a roll, comprising a main body adapted to lie along the outer periphery of the roll, a wing hingedly connected to each side of the main body and adapted to lie along a radial surface of the roll, and locking means for joining the inner ends of the wings together. The main body is provided with a blade and a window for the passage of the tape to the blade. Each wing is provided with fingers and each finger is provided with an inwardly-extending peg for engaging the radial surface of the roll.

4 Claims, 5 Drawing Figures

SHEAR

BACKGROUND OF THE INVENTION

In using a roll of tape, it is often quite difficult to remove short lengths of tape for use. Even when one is able to tear off a short length of tape, the end which remains on the roll sticks to the roll; this makes it difficult to separate the end from the remainder of the roll to start peeling off another length. It is also difficult to tear the tape, if the body of the tape is formed of plastic or some other tough material. Attempts have been made to provide a dispenser for holding a roll of tape, so that it is easy to make a tear and still retain the roll end separated from the roll, so that it is ready to be grasped when the next length of tape is to be removed. Such attempts have been less than successful. For one thing, it has been necessary to provide a different dispenser for each size roll of tape. Furthermore, as the roll becomes smaller and smaller, the apparatus tends to become more awkward, since it was designed for a roll of greater thickness. In addition, such dispensers are quite complicated and expensive. It would be desirable to provide a shear or dispenser that is inexpensive enough to be sold with the roll itself. Also, it would be desirable that such a dispenser be collapsible or small enough to be packaged with the roll, preferably in the hollow center of the roll. These and other difficulties experienced with the prior art devices have been obviated in a novel manner by the present invention.

It is, therefore, an outstanding object of the invention to provide a shear intended to be mounted on a roll of tape for dispensing short lengths thereof.

Another object of this invention is the provision of a dispenser mounted on a roll of tape which, after a portion of the tape has been removed, holds the free end of the roll on the tape separated from the rest of the roll for easy grasping.

A further object of the present invention is the provision of a compact shear for use on a roll of tape, which shear is capable of being packaged with the roll.

It is another object of the instant invention to provide a dispenser or shear which is simple in construction, which is inexpensive to manufacture, and which is capable of a fairly long life of useful service.

A still further object of the invention is the provision of a shear which is capable of being used on rolls of tape of different thicknesses and also compensates for change in the size of the roll as the tape is used.

With these and other objects in view, as will be apparent to those skilled in the art, the invention resides in the combination of parts set forth in the specification and covered by the claims appended hereto.

SUMMARY OF THE INVENTION

In general, the present invention consists of a dispenser or shear for tape in a roll. The shear is provided with a main body that is adapted to lie along the outer periphery of the roll and has a blade extending radially. A wing is hingedly connected to each side of the main body and is adapted to lie along a radial surface of the roll. Locking means joins the inner ends of the wings to hold the wings against the roll.

Most specifically, the main body is formed with a window for the passage of the tape from the outer periphery of the roll to the blade. The wings are provided with laterally-extending fingers, each finger having an inwardly-extending peg adjacent its outer end.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
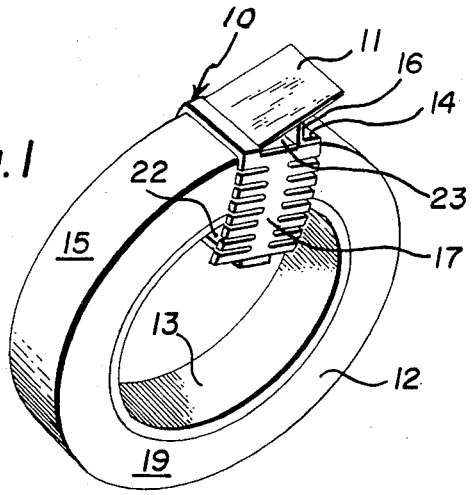
FIG. 1 is a perspective view of a shear incorporating the principles of the present invention and shown in use on a roll of tape.

Referring first to FIG. 1, which best shows the general features of the invention, the shear, indicated generally by the reference numeral 10, is shown in use with a roll 12 of tape 11. In general, the tape consists of a web of strong sheet, such as reinforced paper or polyvinyl chloride sheet with a layer of adhesive (such as pressure-sensitive adhesive) applied to its undersurface. The layers of tape, therefore, stick together because of the adhesive lying between sheets of the inert strong material. As is evident in the drawing, the coils or layers of tape are applied to a central core tube 13 usually formed of cardboard. The shear has a main body 14 which lies along the outer periphery 15 of the roll. The main body 14 has a blade 16 extending radially of the roll.

Figure 2:
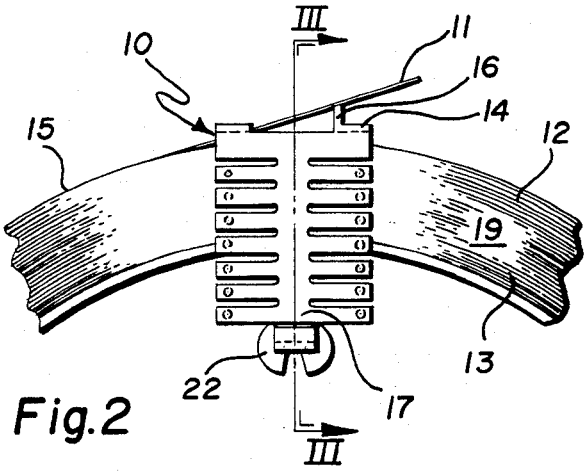
FIG. 2 is a front elevational view of the shear.
Figure 3:
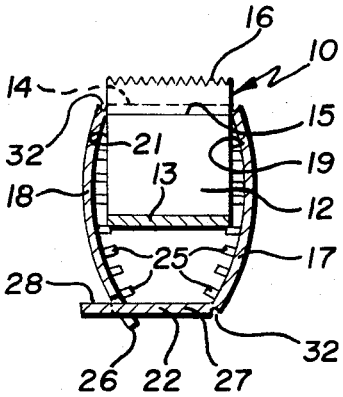
FIG. 3 is a vertical sectional view of the shear taken on the line III—III of FIG. 2.

Referring to FIGS. 2 and 3, it can be seen that a wing 17 and 18 is hingedly connected to each side of the main body 14 and is adapted to lie along a radial surface 19 and 21, respectively, of the roll 12. Locking means 22 joins the inner (closest to the center of the roll) ends of the wings 17 and 18 together to clamp the wings against the radial surfaces 19 and 21 of the roll.

Figure 4:
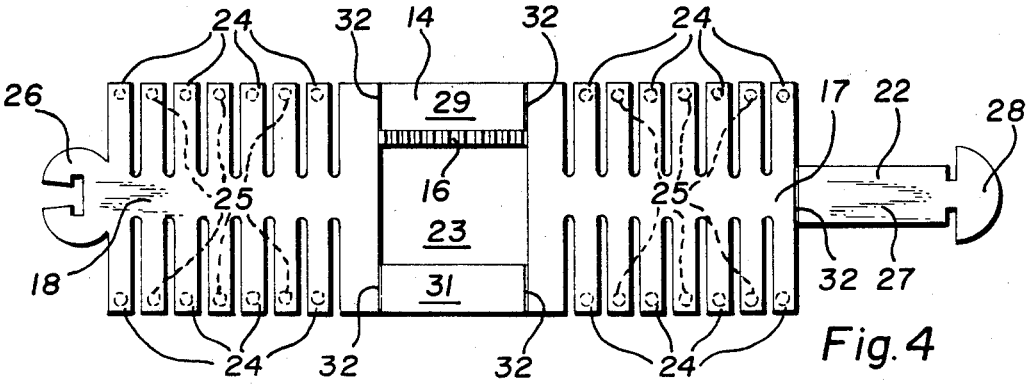
FIG. 4 is a plan view of the shear after manufacture and before it is applied to a roll of tape.
Figure 5:
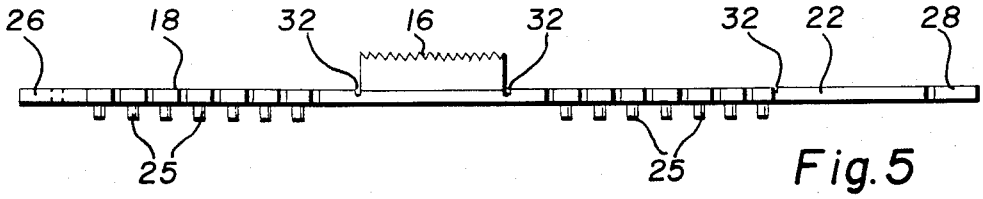
FIG. 5 is an edge view of the shear in the condition of FIG. 4.

Referring now to FIG. 4, which shows the shear 10 before it is applied to a roll of tape, it can be seen that the main body 14 is formed with a window 23 which serves for the passage of the tape 11 from the outer periphery 15 of the roll to the blade 16. This relationship is particularly well shown in FIG. 1. The wings 17 and 18 are provided with laterally-extending fingers 24, each finger having an inwardly-extending peg 25 adjacent its outer end.

As is best evident in FIGS. 3 and 4, the locking means 22 consists of a slotted element 26 that extends from the wing 18 and a strap 27 hinged to and extending from the wing 17. The strap 27 has an enlargement 28 to lock it in the slot of the element 26. It is evident in FIG. 4 that the main body 14 consists of two spaced parallel beams 29 and 31 defining the window 23 between them. The blade 16 is formed as a wall which is integral with the beam 29 and extends from the inner edge thereof at the window 23. The free edge of the blade 16 is sharpened and serrated.

In the preferred embodiment, the shear 10 is integrally formed of an elastomer plastic, such as high density polyethylene. The hinges between the main body 14 and the wings 17 and 18, as well as the hinge between the strap 27 and the wing 17 are made by forming a groove 32 in the plastic. The density and rigidity of the plastic is selected in such a way that, when the plastic has the thickness of the beams 29 and 31, the wings 17 and 18, and the blade 16, it is substantially rigid. When its thickness has been reduced by the grooves 32, a flexible or bending action can take place so that it can act as a hinge. Additionally, the grooves which define the fingers 24 render them fairly flexible.

The operation and advantages of the present invention will now be readily understood in view of the above discussion. The shear 10 is applied to the tape roll 12 by placing the beams 29 and 31 transversely along the periphery 15 of the roll. The beams thus form the main body 14 and the blade 16 extends radially away from the main body. The tape 11 is passed through the window 23 and over the blade 16. Wings 17 and 18 are then pressed downwardly along the radial surfaces 19 and 21 of the roll and the strap 27 is hingedly bent about its connection to the wing 17 until its enlargement 28 snaps into the enlarged portion of the slot on the slotted element 26 which extends from the wing 18. The locking means 22 (that is thus formed) serves to cause the entire apparatus to embrace the roll tightly, but not tightly enough to prevent it from sliding around the roll. Depending on the radial thickness of the roll, some of the pegs 25 press against the radial surfaces 19 and 21 where others extend into the bore or opening formed by the sleeve or core 13. Usually one peg 25 will press against the inner surface of the core 13.

In order to remove a piece of tape, it is first necessary to grasp the roll 12 at a portion thereof spaced away from the shear 10. Then, the length of tape that lies against the blade 16 is lifted up and pulled in the opposite direction against the edge of the beam 31. This causes the shear to slide circumferentially around the roll, and also causes a portion of the tape to emerge through the window 23. When a selected length of tape has been reached, the user simply presses tape downwardly against the serrated edge of the blade 16 and tears it off. This leaves the remainder of the tape with its free end lying against the blade ready to be grasped for the the next operation. In order to remove the dispenser from the tape, of course, it is only necessary to release the enlargement 28 from the slot in the element 26, so that the strap 27 returns to its position in the plane of the wing 17. The wings 17 and 18 then swing outwardly away from the radial surfaces 19 and 21 of the roll and, because of the resilience in the hinges defined by the grooves 32, they move upwardly into the plane of the main body 14. It is then, of course, an easy matter to remove the shear from the roll.

It can be seen, therefore, that the present invention provides a simple answer to many of the problems encountered in this art. For one thing, as is evident in FIG. 4, it is possible to make the device in a relatively simple manner of one piece of plastic, preferably by the injection molding process. There are no intricate parts to become broken or out of adjustment. As a matter of fact, the device lends itself to being sold in a package in which the shear is carried in the interior of the tubular cardboard core 13. The dispenser adapts itself very readily to different radial thicknesses of the roll. As the roll becomes smaller, a different peg 25 will rest against the inner surface and provide a bearing for the sliding action around the roll as a strip of tape is pulled from the periphery.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Shear for tape in a roll having an inner circumferential surface which defines a central opening, comprising:

(a) a main body adapted to lie along the outer periphery of the roll, the main body having a blade extending radially of the roll, and a window for the passage of the tape from the outer periphery of the roll to the blade, (b) a wing hingedly connected to each side of the main body and adapted to lie along a radial surface of the roll, said wing being provided with laterally-extending springy fingers, each finger having an inwardly-extending peg adjacent its outer end which is adapted to bear against the radial surface of the roll, and (c) locking means adapted to extend into said central opening for joining the inner ends of the wings together to hold the wings against the roll so that the pegs of the fingers which are aligned with the radial surfaces of the roll bear against said radial surfaces under tension and the pegs of the fingers which are aligned with said central opening are urged into said central opening, so that at least one of the pegs which extends into said central opening bears against said inner circumferential surface for maintaining the outer periphery of the roll against the main body of the shear, whereby the shear is self adjusting to the changing diameter of the roll as it is used.

2. Shear as recited in claim 1, wherein the main body consists of two spaced, parallel beams defining the aforesaid window between them, the blade consisting of a wall integral with one of the beams and extending from the edge at the window, the free edge of the blade being sharpened and serrated.

3. Shear as recited in claim 1, wherein the shear is integrally formed of an elastomer plastic, the hinges between the main body and the wings and between the one wing and the strap are made by forming a groove in the plastic.

4. Shear for tape in a roll which has a central opening, comprising:

(a) a main body adapted to lie along the outer periphery of the roll, the main body having a blade extending radially of the roll, and a window for the passage of the tape from the outer periphery of the roll to the blade, (b) a wing hingedly connected to each side of the main body and adapted to lie along a radial surface of the roll, said wing being provided with laterally-extending fingers, each finger having an inwardly-extending peg adjacent its outer end which is adapted to bear against the radial surface of the roll, and (c) locking means adapted to extend into said central opening for joining the inner ends of the wings together to hold the wings against the roll, said locking means comprising a slotted element extending from one wing and a strap hinged to and extending from the other wing, the strap having an enlargement to lock it in a slot in the slotted element.

* * * * *